US006994772B2

(12) United States Patent
Kimbara et al.

(10) Patent No.: US 6,994,772 B2
(45) Date of Patent: Feb. 7, 2006

(54) METHOD OF MANUFACTURING HOLLOW FIBER FORMED BODY, FIBER FORMED HOLLOW BODY, AND DEVICE FOR MANUFACTURING THE HOLLOW FIBER FORMED BODY

(75) Inventors: Hiromichi Kimbara, Tochigi (JP); Koichi Sagara, Tochigi (JP); Masayuki Osaki, Tochigi (JP); Tokuo Tsuura, Tochigi (JP)

(73) Assignee: Kao Corporation, Tokyo (JP)

( * ) Notice: Subject to any disclaimer, the term of this patent is extended or adjusted under 35 U.S.C. 154(b) by 18 days.

(21) Appl. No.: 10/381,438

(22) PCT Filed: Jul. 30, 2002

(86) PCT No.: PCT/JP02/07756

§ 371 (c)(1),
(2), (4) Date: Jul. 18, 2003

(87) PCT Pub. No.: WO03/016627

PCT Pub. Date: Feb. 27, 2003

(65) Prior Publication Data

US 2004/0011489 A1 Jan. 22, 2004

(30) Foreign Application Priority Data

Jul. 31, 2001 (JP) ..... 2001-232737
May 9, 2002 (JP) ..... 2002-134563

(51) Int. Cl.
*D21F 13/00* (2006.01)

(52) U.S. Cl. ..... 162/218; 162/219; 162/220; 162/224; 162/230; 162/231; 162/387; 162/390; 425/358; 425/412; 425/DIG. 14; 425/DIG. 44

(58) Field of Classification Search ..... 162/218, 162/219, 220, 224, 230, 231, 387–390; 425/358, 425/412, DIG. 14, DIG. 44
See application file for complete search history.

(56) References Cited

U.S. PATENT DOCUMENTS 2,961,043 A 11/1960 Hicks et al.

FOREIGN PATENT DOCUMENTS

| | | |
|---|---|---|
| EP | 1059384 | 12/2000 |
| JP | 35-9669 | 7/1960 |
| JP | 51-43408 | 4/1976 |
| JP | 52-128412 | 10/1977 |
| JP | S-52-128412 | * 10/1977 |
| JP | 60-223640 | 11/1985 |
| JP | 02-139205 | 5/1990 |
| JP | 03-137300 | 6/1991 |

(Continued)

*Primary Examiner*—Mark Halpern
(74) *Attorney, Agent, or Firm*—Oblon, Spivak, McClelland, Maier & Neustadt, P.C.

(57) ABSTRACT

Disclosed is a method of producing a fiber-molded hollow article by using a papermaking mold (2) composed of splits (21, 22) which are joined to form a cavity (20) having two openings (20*a*, 20*b*) connecting with the outside and an expandable pressing member (3) adapted to be placed in the cavity (20). The method comprises the steps of immersing each of the splits (21, 22) before being joined in a fiber slurry to form a fiber preform (10*a*, 10*b*), joining the splits (21, 22) each having the fiber preform (10*a*, 10*b*) formed thereon while placing the pressing member (3) in the cavity (20), and molding and dewatering a molded article (1) in the papermaking mold (2).

18 Claims, 7 Drawing Sheets

FOREIGN PATENT DOCUMENTS

| | | |
|---|---|---|
| JP | 05-057732 | 3/1993 |
| JP | 11-036200 | 2/1999 |
| JP | 2000-239998 | 9/2000 |
| JP | 2001-55697 | 2/2001 |

* cited by examiner 100
22d
22
22a
22b
22c
2
21
20
21a
21b
21c
20a
20b
10b
10a
3
33
34
1

100
42
42a
42b
42c
42d
42e
41
41a
41b
41c
41d
41e
1
3
4
33

METHOD OF MANUFACTURING HOLLOW FIBER FORMED BODY, FIBER FORMED HOLLOW BODY, AND DEVICE FOR MANUFACTURING THE HOLLOW FIBER FORMED BODY

This application is a 371 of PCT/JPO2/07756 filed on 30 Jul. 2002.

TECHNICAL FIELD

The present invention relates to a method of producing a fiber-molded hollow article, a fiber-molded hollow article, and an apparatus for producing a fiber-molded hollow article.

BACKGROUND ART

Conventional techniques pertinent to production of pulp molded articles include the one disclosed in JP-B-35-9669, which comprises the steps of inserting a core having an expandable film into a fiber preform with an opening that has been deposited in a papermaking mold through the opening and feeding a fluid into the inside of the film to expand the film whereby the preform is pressed onto the inner wall of the papermaking mold and dewatered.

The above-described method of producing a pulp molded article is suited to mold hollow containers with an opening facing up but unsuitable for producing fiber-molded tubular hollow articles having a bend or a twist.

The technique disclosed in JP-A-52-128412 is known as a conventional method relating to the production of a fiber-molded bent hollow article. According to the technique, an L-shaped molded article is deposited and dewatered by using a set of splits of a papermaking mold joined to form a cavity having two or more openings connecting with the outside and two pressing members inserted into the papermaking mold through the openings. Because insertion and extraction of the pressing members are through the openings of the cavity, the pressing member cannot be inserted into some cavities that are so complicated as to have a plurality of bends. Besides, this technique is difficult to apply to the production of fiber-molded hollow articles with a smaller inner diameter at the opening than the inner diameter at the intermediate portion or fiber-molded tubular hollow articles with a twist.

The technique taught in JP-A-2000-239998 is known for the production of a fiber-molded tubular hollow article having a plurality of openings. The technique comprises separately forming fiber preforms in a plurality of split molds and joining the split molds to unite the fiber preforms into one body thereby to produce a tubular molded article with a uniform thickness. In this regard it has been desired to develop a method of making a fiber-molded tubular hollow article with a uniform thickness in which fiber preforms are united into one body more firmly.

Accordingly, an object of the present invention is to provide a fiber-molded hollow article with a uniform thickness which has a complicated bent configuration and is composed of fiber preforms firmly united into one body, a convenient method of producing the molded article, and an apparatus for producing the molded article.

DISCLOSURE OF THE INVENTION

The present invention accomplishes the above object by providing a method of producing a fiber-molded hollow article by using a papermaking mold composed of a set of splits which are joined to form a cavity having two or more openings connecting with the outside and an expandable pressing member adapted to be placed in the cavity, which comprises:

a first step of immersing each of the splits before being joined in a fiber slurry to form a fiber preform on the cavity-forming surface of the split, a second step of joining the splits having the fiber preform formed thereon and placing the pressing member in the cavity, and a third step of dewatering the fiber preforms in the papermaking mold to form a fiber-molded hollow article.

The present invention also accomplishes the above object by providing a fiber-molded hollow article having a bend or a twist which is composed of a plurality of fiber preforms united into one body.

The present invention also accomplishes the above object by providing an apparatus for producing a fiber-molded hollow article comprising a papermaking mold composed of a set of splits which are adapted to be joined to form a cavity and a pressing member which is adapted to dewater fiber preforms each formed on each of the splits to form a fiber-molded hollow article, wherein the cavity of the papermaking mold has two or more openings connecting with the outside and the pressing member is expandable and bendable so as to be placed in the cavity between at least two of the openings.

BRIEF DESCRIPTION OF THE DRAWINGS

FIG. 1(*a*) is a partial cross-section showing the papermaking step using a split. FIG. 1(*b*) is a plan view of FIG. 1(*a*).

FIG. 2(*a*) shows a pressing member disposed on a fiber preform, and FIG. 2(*b*) shows a papermaking step with a set of splits. FIG. 2(*c*) illustrates a dewatering and molding step.

FIG. 3(*a*) shows transfer from the dewatering and molding step to a drying step. FIGS. 3(*b*) and 3(*c*) show the step of drying using the pressing member. FIG. 3(*d*) illustrates a fiber molded article and the pressing member removed from a drying mold.

FIG. 5(*a*) shows a papermaking step. FIG. 5(*b*) shows the state before a pressing member is disposed. FIG. 5(*c*) shows a dewatering step. FIG. 5(*d*) shows the splits separated apart.

FIG. 6(*a*) shows the state before a preform and a pressing member are disposed in a drying mold. FIG. 6(*b*) shows the state with the preform and the pressing member disposed in the drying mold. FIG. 6(*c*) illustrates the state of a molded article and the pressing member separated apart.

FIG. 7(*a*) and 7(*d*) show a step involved in making a fiber-molded hollow article with a joint flange. FIGS. 7(*b*) and 7(*d*) and FIGS. 7(*c*) and 7(*f*) show a step involved in making a fiber-molded hollow article with a flange for fitting.

BEST MODE FOR CARRYING OUT THE INVENTION

The present invention will be described based on preferred embodiments thereof.

Figure 1A:
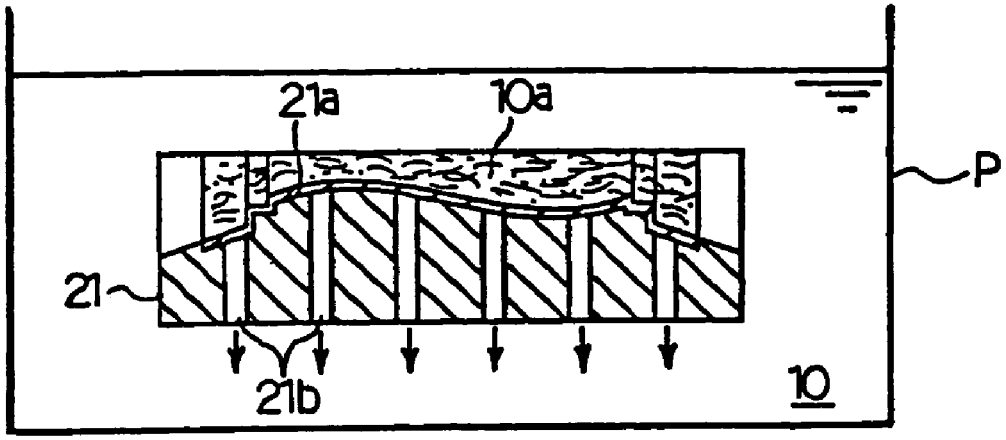
FIGS. 1(*a*) and 1(*b*) schematically illustrate the papermaking step in a first embodiment of the method of producing a fiber-molded hollow article according to the present invention which is adopted to the production of the tubular molded article.
Figure 1B:
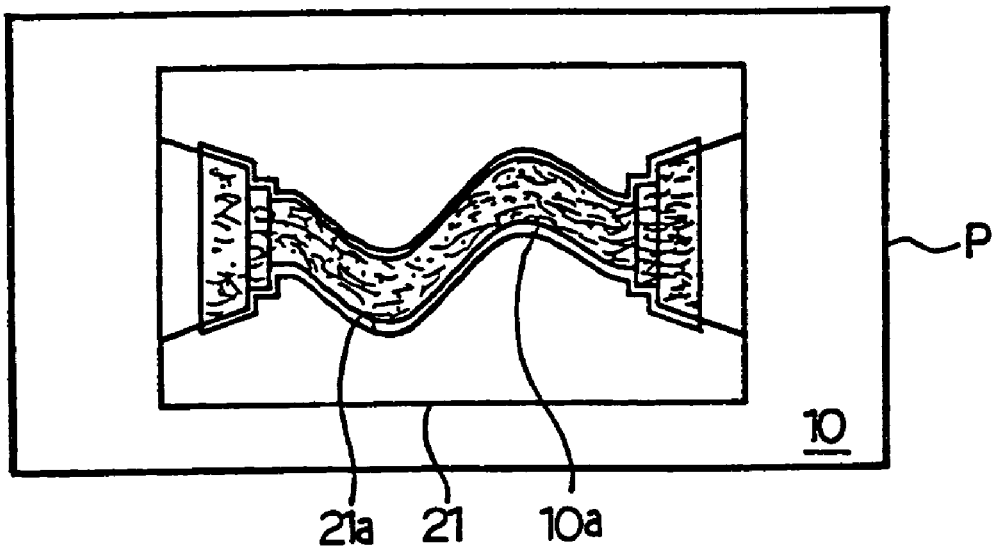
Figure 2A:
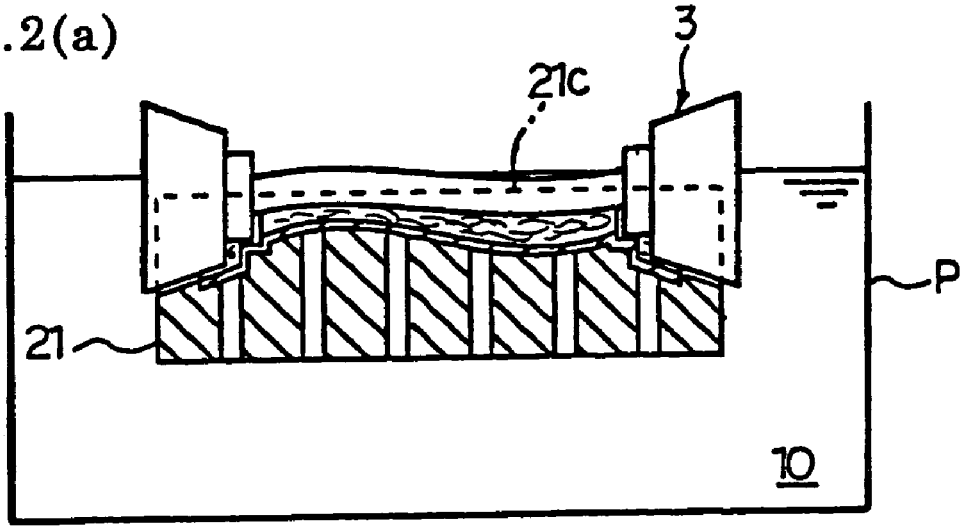
FIGS. 2(*a*), 2(*b*), and 2(*c*) present partial cross-sections schematically showing the procedures of papermaking and dewatering steps in the first embodiment.
Figure 2B:
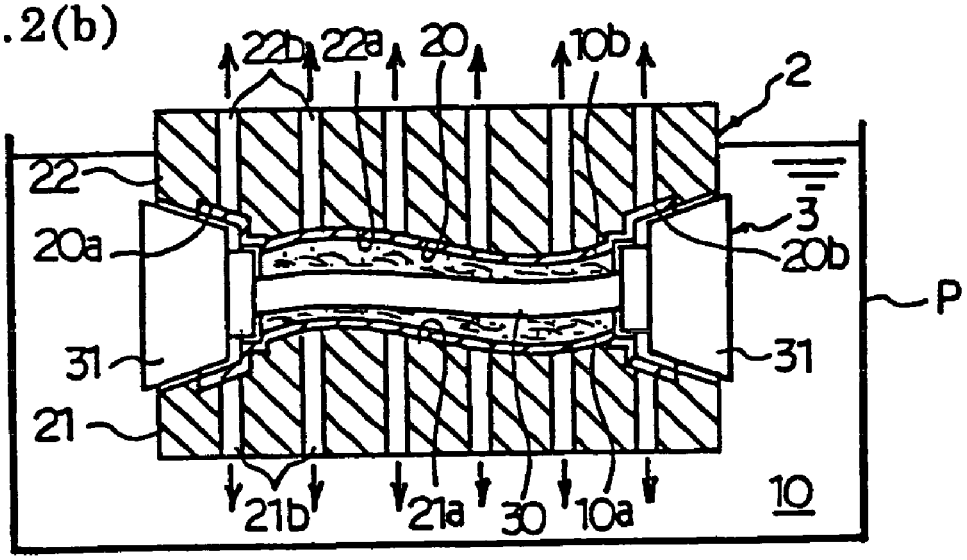
Figure 2C:
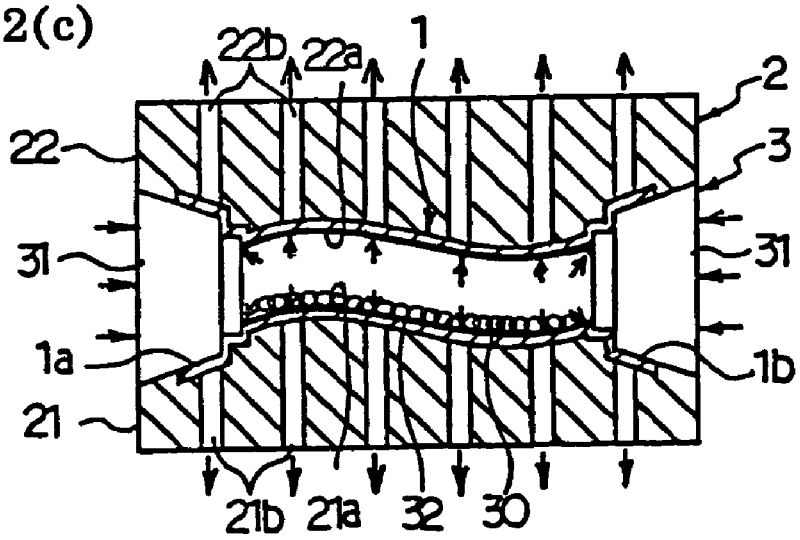
Figure 3A:
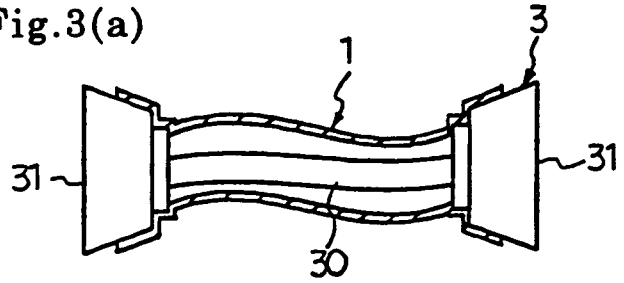
FIGS. 3(*a*) to (*d*) are partial cross-sections schematically illustrating the procedures of the production in the first embodiment.
Figure 3B:
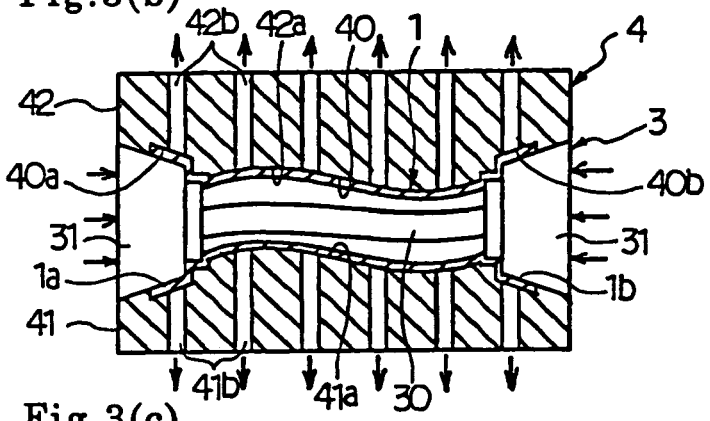
Figure 3C:
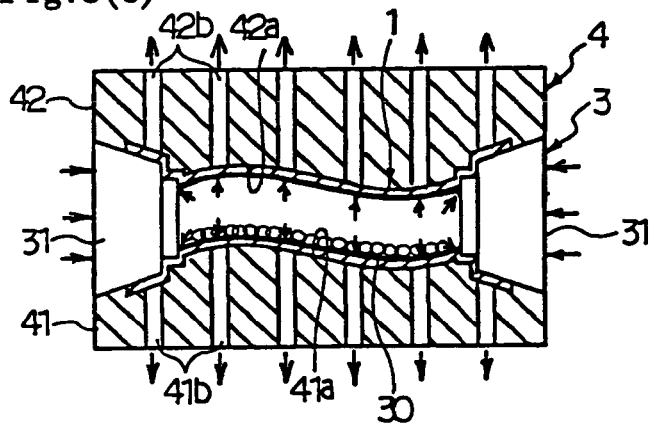
Figure 3D:
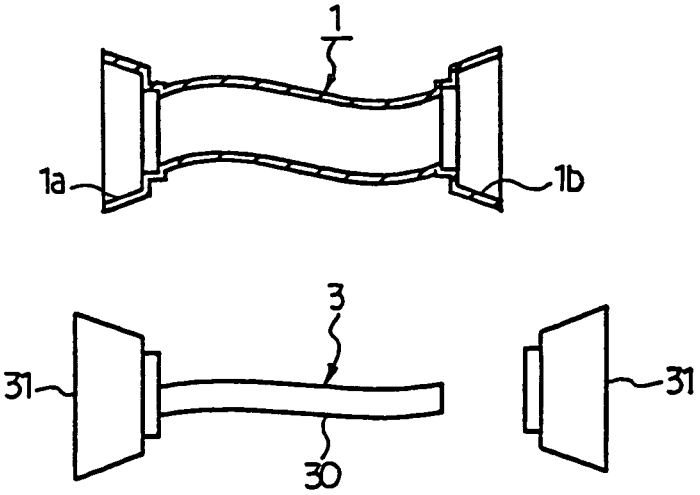

FIGS. 1 to 3 show the first embodiment of the method for producing a fiber-molded hollow article according to the present invention, which is an application to the production of a tubular fiber molded article. In there figures, numeral 1 indicates a fiber-molded hollow article (hereinafter sometimes referred to simply as a molded article); 10, a fiber slurry; and P, a fiber slurry tank.

As shown in FIG. 2(*b*), the molded article production method of the first embodiment is carried out by using a papermaking mold 2 composed of a pair (set) of splits 21 and 22 assembled to form a cavity 20 having a bent and openings 20*a* and 20*b* connecting with the outside and an expandable pressing member 3 adapted to be disposed in the cavity 20.

While not shown in the figures, the method according to this embodiment is executed by using a production apparatus having a lifting mechanism with which the splits 21 and 22 of the papermaking mold 2 are immersed in the fiber slurry 10 and pulled out of the fiber slurry 10 and a mold clamping mechanism with which the papermaking mold 2 is opened and closed in the fiber slurry or in the air. The lifting mechanism is composed of a hydraulic cylinder and stably moves the papermaking mold 2 in a vertical direction. The mold clamping mechanism has a hydraulic cylinder mechanism, with which to join or separate the splits in parallel to the mold opening and closure direction and to exert a prescribed clamping force to the papermaking mold 2 when closed. The mold clamping mechanism makes it possible to stably open and close the papermaking mold 2 in the fiber slurry. The hydraulic cylinder mechanism of the lifting mechanism and the mold clamping mechanism may be replaced with a linking mechanism, an air cylinder mechanism, a servo mechanism or any other driving mechanism or a combination of these mechanisms.

The lifting mechanism may be composed of a rotating shaft for rotating the papermaking mold 2 around its longitudinal axis, a driving source for rotating the rotating shaft, and arms supporting the papermaking mold which are arranged around the rotating shaft at an interval of prescribed angle. In this case, a set of the splits making the papermaking mold are fixed to the tip of the arms horizontally, i.e., in parallel to the surface of the fiber slurry. While the papermaking mold makes one rotation round the rotation axis, immersion of the splits in the fiber slurry, formation of the respective fiber preforms, and dewatering and molding of the fiber-molded hollow article can be executed. The papermaking mold is opened in the outside of the fiber slurry, and the fiber-molded hollow article after the dewatering and molding step is transferred into a drying mold described infra together with the pressing member 3.

Each split 21 or 22 has a cavity-forming surface 21*a* or 22*a*, flow passageways 21*b* or 22*b* which are open on the cavity-forming surface 21*a* or 22*a*, and a papermaking screen (not shown) which covers the cavity-forming surface 21*a* or 22*a*.

The flow passageways 21*b* and 22*b* are connected to the respective pipe lines (not shown) leading to a suction means (not shown), such as a suction pump. There are formed flow channels, while not shown, on the cavity-forming surfaces 21*a* and 22*a* to make connections among the flow passageways 21*b* and among the flow passageways 22*b* so that the liquid component of the fiber slurry may be discharged outside through the flow passageways 21*b* and 22*b* during papermaking and dewatering.

The material of the papermaking screen includes, but is not limited to, natural materials such as plant fibers and animal fibers, synthetic resins such as thermoplastic resins, thermosetting resins, regenerated resins, and semi-synthetic resins, and metals such as stainless steel, copper, and brass.

As shown in FIG. 2(*b*), the cavity 20 has two openings 20*a* and 20*b* connecting with the outside. The cavity 20 has such two bents that one cannot see through from the opening 20*a* to the opening 20*b*.

The pressing member 3 has an expandable hollow pressing part 30 made of a hollow elastic member and a pressing part 31 attached to both ends of the hollow pressing part 30. It is bendable so that it can be disposed between the openings 20*a* and 20*b* of the cavity 20. The pressing parts 31 are used in cases where the hollow pressing part 30 alone is expected to be insufficient for pressing the ends of the fiber-molded hollow article or where the hollow pressing part 30 should be set securely in the papermaking mold 2 or the drying mold 4. The pressing parts 31 each have a fluid flow passageway (not shown) leading to the hollow pressing part 30. The flow passageways are connected to a pipe line (not shown) leading to a compressor or a suction pump. The hollow pressing part 30 expands on feeding thereto a fluid described infra through the pipe line or shrinks on withdrawing the fluid therefrom through the pipe line.

The pressing parts 31 have tapered ends, which are fitted into tapered openings 1*a* and 1*b* of the molded article 1. The molded article 1 being held between these tapered ends and the papermaking mold 2 or the drying mold 4 (see FIG. 3), it is uniformly dewatered or dried even at every corner of the openings.

The end of the pressing part 31 is shaped smaller than the opening of the papermaking mold 2 or the drying mold 4 described infra (FIG. 3) and the opening of the fiber molded article 1 and longer than the depth of the opening of the molded article 1. Thus, the pressing part 31 can be smoothly attached to or detached from the papermaking mold 2 or the drying mold 4 or the molded article and be easily separated from the molded article 1. Further, on applying a pressing force during molding as shown in FIG. 2(*c*), the pressing part 31 comes into close contact with every corner of the opening of the papermaking mold or the drying mold and the opening of the molded article 1 so that the pressing force is securely transmitted to the molded article 1.

The material of the hollow pressing part 30 of the pressing member 3 is not particularly limited as long as it is elastic. From the standpoint of durability, heat resistance, moldability, etc., it is preferred to use natural rubber or synthetic rubbers such as urethane, fluororubber, silicone rubber, and elastomers. The pressing part 31 can be made of rigid materials, such as metals, as well as the above-described elastic materials.

The hollow pressing part 30 of the pressing member 3 contains a weight 32 (see FIG. 2(*c*)) so that it is prevented from floating due to buoyancy when placed on the fiber preform. On the other hand, the weight 32 can deform the fiber preform 10*a* because of its own weight. The weight 32 can also bring the hollow pressing part 30 into too intimate contact with the fiber preform 10*a*, which may adversely affect subsequent formation of a fiber layer or the transfer after the dewatering and molding step. Therefore, the weight is preferably not so heavy as to produce these adverse influences. While the shape of the weight 32 is not particularly limited, the following forms are advisable for avoiding weight imbalance in the hollow pressing part 30 and for the ease of placement in, or removal from, the hollow pressing part 30. Preferred forms of the weight include a chain, a cord, and a plurality of spherical, elliptical or like weights threaded on a string, etc. with a stop at both ends thereof to prevent the weights from coming off.

As shown in FIGS. 1(*a*) and (*b*), the split (one of the splits) 21 is immersed in the fiber slurry 10 with its cavity-forming side (papermaking surface) up, and the fiber slurry 10 is sucked up through the flow passageways 21*b*. Whereupon, the solid content is deposited on the papermaking screen to form an almost arch-shaped fiber preform 10*a*.

The fiber slurry preferably consists of pulp fiber and water. The fiber slurry may contain, in addition to pulp fiber and water, inorganic substances such as talc and kaolinite, inorganic fibers such as glass fiber and carbon fiber, particulate or fibrous thermoplastic synthetic resins such as polyolefins, non-wood or plant fiber, polysaccharides, and the like. The amount of these additional components is preferably 1 to 70% by weight, particularly 5 to 50% by weight, based on the total amount of pulp fiber and these components. Dispersants for pulp fiber, molding aids, colorants, coloring assistants, antifungals, and the like may be added appropriately to the fiber slurry. Sizing agents, pigments, fixatives, etc. may also be added appropriately.

Esterified pulp having acrylic fiber added thereto may be mixed into the pulp fiber. The esterified pulp includes those disclosed in Japanese Patent Application No. 5200/77, such as phosphated cellulose fiber, phosphated polyvinyl alcohol fiber, and the like, which are obtained by esterifying natural cellulose or a derivative thereof or a synthetic fiber, e.g., polyvinyl alcohol.

A material prepared by incorporating acrylic fiber into a slurry containing the esterified pulp followed by beating may be mixed into the fiber slurry.

The pressing member 3 is then placed on the fiber preform 10*a* as shown in FIG. 2(*a*). Separately, the split 22 (the other split) is immersed in the fiber slurry to form another arch-shaped fiber preform 10*b* (see FIG. 2(*b*)).

It is preferred that the pressing member 3 be disposed on the fiber preform 10*a* while the split 21 is right under the liquid level of the fiber slurry 10. The phrase "right under the liquid level" is intended to mean that the joint surface 21*c* of the split 21 is within 100 mm deep from the liquid level of the fiber slurry 10. The depth from the liquid level is preferably 0 to 50 mm. If it exceeds 100 mm, it would be difficult to dispose the pressing member at a right position due to the buoyancy of the hollow pressing member. If the fiber preform comes out of the slurry, the fiber preform loses too much water content due to suction and the like, which can result in a failure to obtain sufficient joint strength between the fiber preforms in the subsequent step.

The fiber preform 1O*b* is formed in the same manner as in the formation of the fiber preform 10*a* on the split 22, except that the split 22 is set with its cavity-forming side 22*a* down. Where the splits 22 and 22 are connected by hinges, and one of them swings to join the other, the cavity-forming side 22*a* of the split 22 may face up.

The splits 21 and 22 having the fiber preforms 10*a* and 10*b* are joined together in the fiber slurry to make the papermaking mold 2 as shown in FIG. 2(*b*). After the papermaking mold 2 is formed in the fiber slurry 10, the fiber slurry 10 is again sucked up through the flow passageways 21*b* and 22*b* to further deposit a fiber layer (not shown) on the surface of the fiber preforms 10*a* and 10*b*. By this deposition, the joint seams between the fiber preforms 10*a* and 10*b* substantially disappear. As a result, the resulting molded article 1 has satisfactory surface properties on its inner surface.

The pressing member 3 is expanded in the papermaking mold 2 to dewater the fiber preforms 10*a* and 10*b* joined into one body, i.e., the molded article 1. In this dewatering and molding step, both the opening portions 1*a* and 1*b* of the molded article 1 are dewatered by pressing the molded article 1 from both ends by the pressing parts 31. At the same time, a fluid is fed into the hollow pressing part 30 to expand it to press the molded article 1 toward the inner wall of the papermaking mold 2 (the cavity-forming surface of each split). Thereafter the papermaking mold 2 and the pressing member 3 are pulled out of the fiber slurry 10, and dewatering is continued while pressing the molded article 1 toward the inner wall of the papermaking mold 2 to form the molded article 1. Because the hollow pressing part 30 is expanded in the fiber slurry 10, it is possible to form the molded article 1 with no joint seems nor level differences and with increased strength. The papermaking mold 2 may be pulled out of the fiber slurry 10 before or while the molded article 1 is pressed.

The fluid which can be used to expand the hollow pressing part 30 of the pressing member 3 includes gases, such as air (pressurized air), hot air (heated and pressurized air), steam, and superheated steam, and liquids, such as oil (heated oil). From the standpoint of operating properties, air, hot air or superheated steam is used for preference.

The pressure of feeding the fluid into the hollow pressing part 30 of the pressing member 3 is appropriately decided according to the fiber preforms to be dewatered and molded. It is preferably 0.01 to 5 MPa, more preferably 0.1 to 3 MPa.

In the dewatering and molding step, while the molded article 1 is pressed toward the inner wall of the papermaking mold 2 by the pressing force of the hollow pressing part 30 and the pressing parts 31, the water content in the molded article 1 is removed by suction through the flow passageways 21*b* and 22*b*. In this way, since the molded article 1 is pressed by the pressing member 3 while getting rid of its water content by suction, it is pressed uniformly to have its wall thickness levelled and dewatered rapidly.

The water content of the molded article 1 having been dewatered and molded is preferably 30 to 80%, more preferably 40 to 70%, from the viewpoint of preventing damage to the molded article 1 in transfer to the subsequent drying step and assuring improved drying efficiency.

The splits 21 and 22 are separated apart, and the dewatered and molded article 1 as containing therein the pressing member 3 is removed from the papermaking mold 2 and then transferred to the drying step as shown in FIG. 3(*a*).

The transfer from the dewatering and molding step to the drying step is carried out with a transfer means (not shown) such as a handling robot which grips the pressing parts 31 and moves the pressing member 3 with the fiber-molded hollow article 1 on into the drying mold 4.

As shown in FIG. 3(*b*), the drying mold 4 is formed of a set of splits 41 and 42 which are joined to form a cavity 40 having openings 40*a* and 40*b*. The pressing member 3 and the fiber-molded hollow article 1 are fitted in the drying mold 4, and the molded article 1 is dried.

The drying mold 4 used in the drying step is composed of the splits 41 and 42 and equipped with a heating means (not shown), such as a heater. Similarly to the splits 21 and 22 of the papermaking mold 2, the splits 41 and 42 each have a cavity-forming surface 41*a* or 42*a* and flow passageways 41*b* or 42*b* open on the cavity-forming surface 41*a* or 42*a*.

The drying mold 4 is heated by the heating means and maintained at a prescribed temperature. The temperature of the drying mold 4 is preferably 100 to 250° C., more preferably 120 to 220° C., for preventing the molded article 1 from scorching while securing the drying efficiency. It is advisable that the drying mold 4 be previously heated and maintained at a prescribed temperature before the fiber-molded hollow article 1 is placed in the drying mold 4.

As shown in FIG. 3(*c*), the opening portions 1*a* and 1*b* of the molded article 1 are dried by pressing the molded article 1 from both ends by the pressing parts 31. At the same time, a fluid is fed into the hollow pressing part 30 to expand it to press the molded article 1 from its inside toward the inner wall of the drying mold 4 (the cavity-forming surface of each split), thereby to dry the molded article 1.

The pressure of feeding the fluid into the hollow pressing part 30 is appropriately decided according to the molded article to be dried. It is preferably 0.01 to 5 MPa, more preferably 0.1 to 3 MPa. The fluids usable in the dewatering step can be used here to expand the hollow pressing part 30.

In the drying step, the molded article 1 is pressed toward the inner wall of the drying mold 4 by the pressing force of the hollow pressing part 30 and the pressing parts 31, while sucking up the water content of the molded article 1 in the same manner as in the dewatering and molding step. In this way, since the molded article 1 is pressed by the pressing member 3 while getting rid of its water content by suction, it is pressed uniformly to have its wall thickness levelled and dried rapidly.

When the molded article 1 is dried to a prescribed water content, the suction through the flow passageways 41*b* and 42*b* is stopped, and the fluid is withdrawn from the hollow pressing part 30 to let the hollow pressing part 30 shrink.

The splits 41 and 42 are then separated apart. As shown in FIG. 3(*d*), the molded article 1 is taken out from the drying mold 4. One end of the hollow pressing part 30 is detached from the pressing part 31, and the pressing member 3 is drawn out of the molded article 1 to complete dewatering and drying.

The molded article 1 thus obtained can be subjected to various post treatments according to necessity, such as trimming, attachment of a separate part, coating on the inner and/or outer surface with a resin layer, printing, and water repellency treatment. In particular, a sodium silicate layer and/or a silicone resin layer provided on the surface of the molded article 1 brings about improved resistance to heat and water.

As described above, according to the production method of the first embodiment, after the fiber preform 10*a* is deposited on the surface of the split 21, the pressing member 3 is disposed on the fiber preform 10*a* while the split 21 is right under the liquid level of the fiber slurry 10. The split 21 and the split 22 having the fiber preform 10*b* are combined to form the papermaking mold 2, and the molded article 1 is dewatered and molded by the pressing member 3. Therefore, a seamless, thin-walled, lightweight and strong molded article having a bend or a twist with uniform wall thickness can be produced efficiently. Because the resulting molded article 1 has high sound absorbing qualities, it exhibits excellent sound damping properties for the sound generated when solid, gas, etc. flows therethrough.

In the method of producing the fiber-molded hollow article according to the first embodiment, the splits are combined to form the papermaking mold 2 in the fiber slurry before they are pulled out of the fiber slurry. The fiber preforms are then pressed from its inside by the pressing member 3 to dewater and mold the molded article 1. Therefore, the wet fiber preforms are united into one body while being dewatered to become a seamless molded article 1 having a uniform thickness.

Since the papermaking mold 2 is assembled by joining the splits 21 and 22, a cavity having a complicated bent or twist configuration can be formed to produce a fiber-molded hollow article having various complicated shapes.

By the use of the pressing member having the pressing part 31 on each end of the hollow pressing part 30, which is designed to provide the molded article 1 with the tapered opening portions 1*a* and 1*b*, the molded article 1 enjoys excellent molding accuracy even at the corners of its opening portions.

Since the pressing member 3 used in the dewatering and molding step is also used in the drying step, the transfer from the dewatering and molding step to the drying step can be effected smoothly to assure improved production efficiency.

Since the drying step is performed by pressing the molded article 1 from its inside toward the inner wall of the drying mold 4 by the pressing member 3, the molded article 1 can be dried efficiently, and a thin-walled and strong molded article with a uniform wall thickness can be produced.

Figure 4:
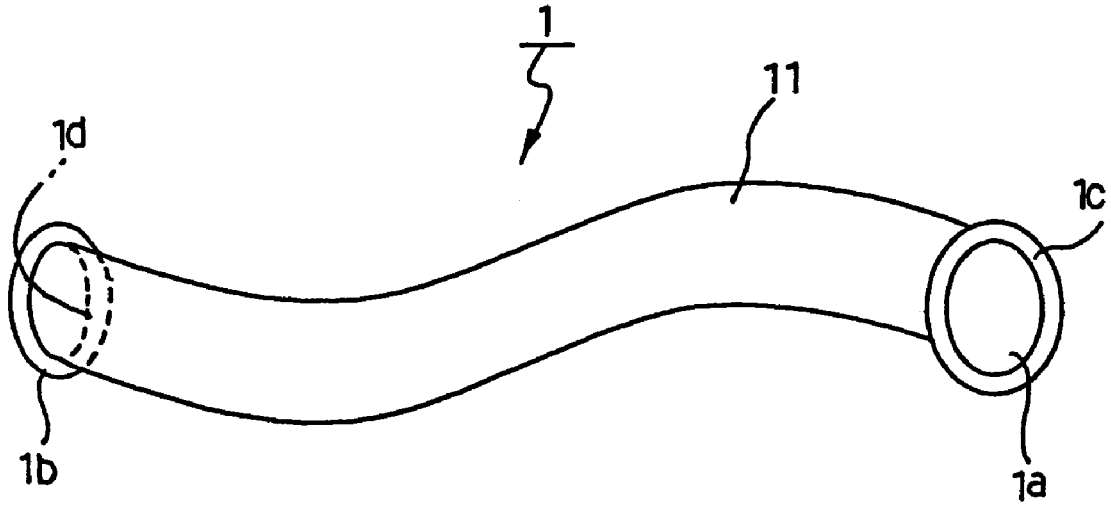
FIG. 4 is a perspective view schematically illustrating an example of the fiber-molded hollow article according to the present invention which is applied to a tubular molded article having two openings.

FIG. 4 shows an example of the fiber-molded hollow article of the present invention applied to a tubular molded article having bends. In FIG. 4, numeral 1 indicates a tubular molded article (hereinafter sometimes referred simply to as a molded article).

The molded article 1 shown in FIG. 4 is formed of two fiber preforms united into one body.

The molded article 1 has two openings 1*a* and 1*b* and a bend 11 between the two openings. The molded article 1 cannot be seen through from the opening 1*a* to the opening 1*b*. The molded article 1 has flanges 1*c* and 1*d* for protecting the openings 1*a* and 1*b*. The flanges 1*c* and 1*d* are each curled outward so that the openings are protected from damage when connected to other tubular molded articles, etc.

The molded article 1 is preferably made solely of pulp fiber. The molded article 1 may contain, in addition to pulp fiber, inorganic substances such as talc and kaolinite, inorganic fibers such as glass fiber and carbon fiber, particulate or fibrous thermoplastic synthetic resins such as polyolefins, non-wood or plant fiber, polysaccharides, and the like. The amount of these additional components is preferably 1 to 70% by weight, particularly 5 to 50% by weight, based on the total amount of pulp fiber and these components. The molded article 1 may further contain appropriately molding aids, colorants, coloring assistants, antifungals, sizing agents, pigments, fixatives, and the like.

The molded article 1 may contain the above-described esterified pulp having acrylic fiber incorporated thereto.

The molded article 1 preferably has a sodium silicate layer and/or a silicone resin layer for imparting high resistance to heat and water.

An embodiment of the apparatus for producing a fiber-molded hollow article according to the present invention will be described by referring to the drawing.

Figures 5A, 5B, 5C, 5D:
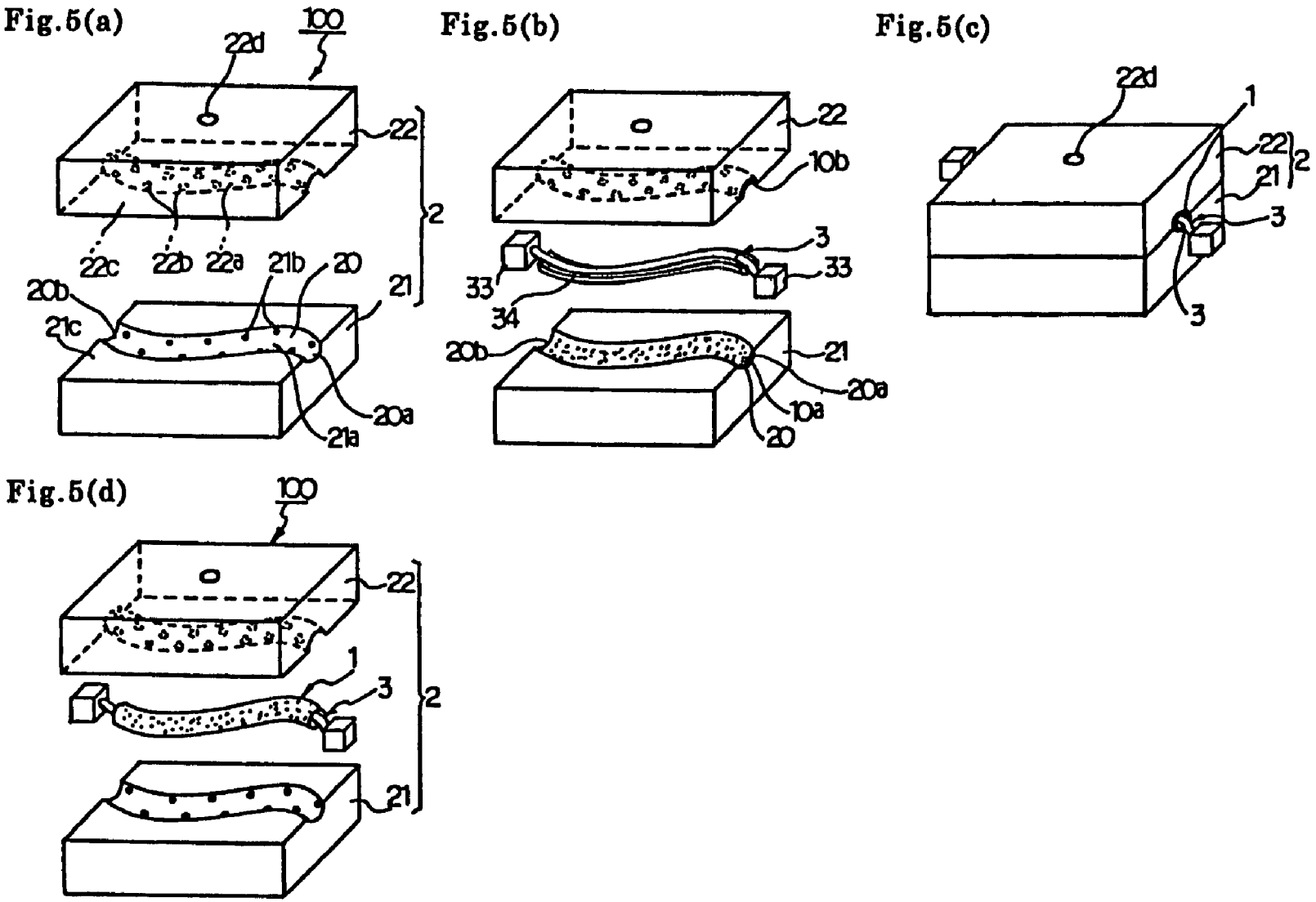
FIGS. 5(*a*) through 5(*d*) are perspectives schematically illustrating the procedures of papermaking and dewatering steps in a second embodiment of the method for producing a fiber-molded hollow article according to the present invention which is applied to the production of a tubular molded article.

The production apparatus 100 according to this embodiment comprises a papermaking mold 2 composed of a set of splits 21 and 22 which are adapted to be joined to form a bent cavity 20 as shown in FIG. 5(*a*) and a pressing member 3 which is adapted to dewater fiber preforms 10*a* and 10*b* formed on the splits 21 and 22 to form the above-described fiber-molded hollow article 1 as shown in FIG. 5(*b*).

As shown in FIG. 5(*a*), the splits 21 and 22 each have a cavity-forming surface 21*a* or 22*a*, flow passageways 21*b* or 22*b* which are open on the cavity-forming surface 21*a* or 22*a*, and a papermaking screen (not shown) made of a liquid permeable material, which covers the cavity-forming surface 21*a* or 22*a*. The joint surface (parting face 21*c*) of each of the splits 21 and 22 is formed substantially on a plane.

The flow passageways 21*b* and 22*b* are gathered into the respective single passageways (only a passageway 22*d* is shown). The opening of each of the single passageways is connected to a pipe line (not shown) leading to a suction means (not shown), such as a suction pump. There are formed flow channels, while not shown, on the cavity-forming surfaces 21*a* and 22*a* to make connections among the flow passageways 21*b* and among the flow passageways 22*b* whereby the liquid of a fiber slurry is smoothly discharged outside through the flow passageways 21*b* and 22*b* during papermaking and dewatering.

The cavity 20 has two openings 20*a* and 20*b* connecting with the outside. Having two bends, the cavity 20 cannot be seen through from the opening 20*a* to the other opening 20*b*.

The pressing member 3 is a hollow tube made of an elastic material. It is expandable. It is bendable to be placed in the cavity 2 between the two openings 20*a* and 20*b*.

The pressing member 3 is detachably attached at both ends thereof to the respective heads 33. Each head 33 is connected to a pipe line (not shown) leading to a compressor, a suction pump, etc. With the heads 33 attached to the pressing member 3, the inside of the pressing member 3 connects with the pipe line so that a fluid (hereinafter described) can be fed into the pressing member 3 or withdrawn therefrom by means of the compressor, the suction pump, etc.

The production apparatus 100 has a pressing member placement mechanism. The pressing member placement mechanism is such that is immersed into a fiber slurry synchronously with a papermaking mold lifting mechanism described infra to place the pressing member 3 on the cavity-forming side(s) 21*c* and/or 22*c* of the split(s) 21 and/or 22.

As shown in FIG. 5(*b*), the pressing member placement mechanism used in this particular embodiment has a guide trough 34 which is bent in agreement with the bent configuration of the cavity-forming surface 21*c* of the split 21 (one of the halves) and a driving mechanism (not shown). The driving mechanism is to move the guide trough 34 in the opening and closure direction of the split 21 so that the pressing member 3 may be placed in the right position on the cavity-forming side of the split 21 and, after placing the pressing member 3, move the guide trough 34 to a position where it does not obstruct. The guide trough 34 has in the inside an adsorption means for adsorbing and holding the pressing member 3 (e.g., a vacuum pad) whereby the pressing member 3 is kept in a bent state in agreement with the configuration of the bent cavity of the split 21.

The driving mechanism is composed of a hydraulic or air cylinder or any other general driving means and a transmission mechanism such as links and gears.

Two or more pressing member placement mechanisms may be used for a set of splits. One pressing member placement mechanism may be adapted to handle two or more pressing members.

Figures 6A, 6B, 6C:
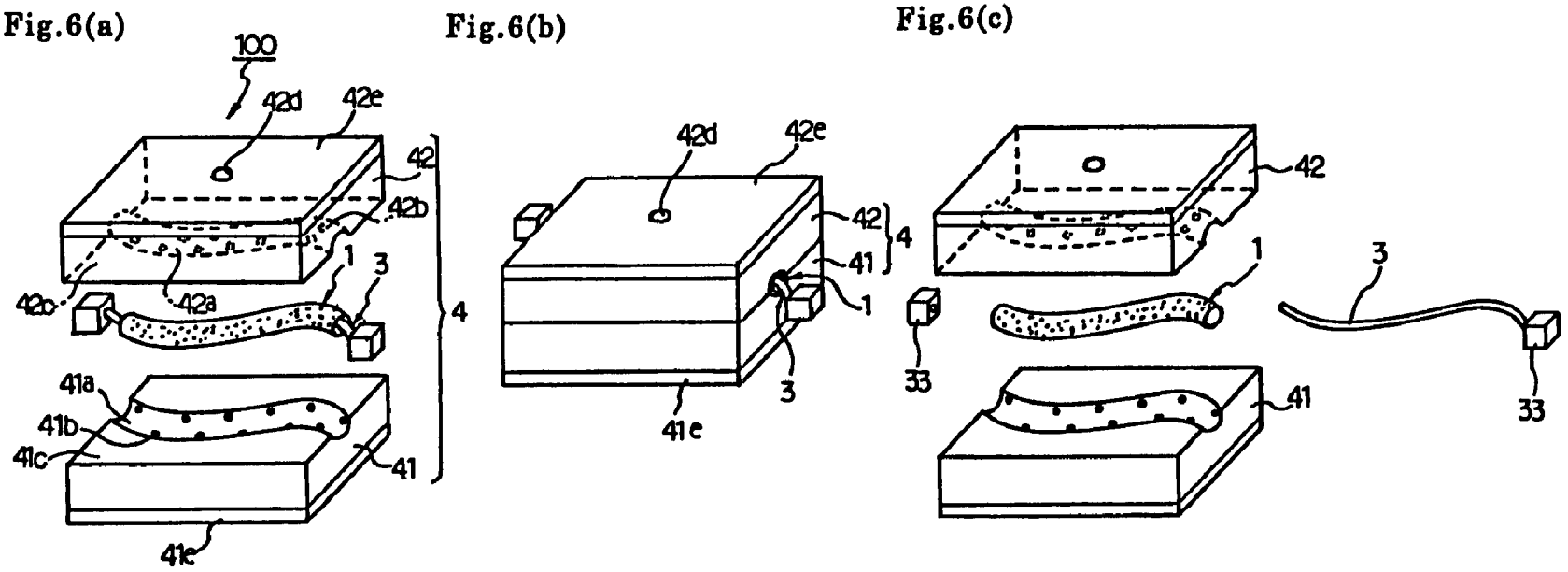
FIGS. 6(*a*) to 6(*c*) schematically illustrate the procedures of a drying step in the second embodiment.

As shown in FIG. 6(*a*), the production apparatus 100 according to this embodiment has a drying mold 4 for drying the fiber-molded hollow article 1 and a transfer means (not shown) for shifting the pressing member 3 having thereon a dewatered fiber-molded hollow article 1 to the drying mold 4.

The drying mold 4 has a pair of splits 41 and 42. The splits 41 and 42 each have a heating means 41*e* and 42*e*, such as a heater. Similarly to the splits 21 and 22 of the papermaking mold 2, the splits 41 and 42 of the drying mold 4 each have a cavity-forming surface 41*a* or 42*a*, flow passageways 41*b* or 42*b* open on the cavity-forming surface 41*a* or 42*a*, a joint surface 41*c* or 42*c*, and a flow passageway (only 42*d* is shown) which gathers the flow passageways 41*b* or 42*b* and leads to the outside.

The transfer means includes a handling robot which grips the heads 33 and shifts the pressing member 3 with the fiber-molded hollow article 1 on into the drying mold 4. The handling robot preferably has fittings, etc. of the shape in agreement with the contour of the molded article so as to prevent damage to the molded article when transferring the molded article to the drying mold.

The production apparatus 100 also has a lifting mechanism (not shown) for putting the papermaking mold 2 into and out of a fiber slurry and a mold clamping mechanism (or a mold opening and closing mechanism) (not shown) for opening and closing the papermaking mold 2 in the fiber slurry or in the air. The lifting mechanism is composed of a hydraulic cylinder mechanism with which the papermaking mold 2 is moved vertically in a stable manner. The mold clamping mechanism has a hydraulic cylinder mechanism combined with a linking mechanism so that the splits may be joined and separated in parallel to the mold opening and closure direction and that a prescribed clamping force may be exerted with the papermaking mold 2 closed. By this mold clamping mechanism, the papermaking mold 2 is stably opened and closed in the fiber slurry. In place of the hydraulic cylinder mechanism, the lifting mechanism and the mold clamping mechanism may have an air cylinder mechanism, a servo mechanism or any other driving mechanism.

The construction and action of the lifting mechanism are the same as described supra.

The second embodiment of the method for producing a fiber-molded hollow article according to the present invention, which is an application to the production of the molded article 1 by use of the production apparatus 100, will then be described. Explanation common to the first and second embodiments is omitted here. Accordingly, the description given to the first embodiment applies to the particulars that are not described here.

FIGS. 5(*a*) through (*d*) schematically illustrate the procedures of the papermaking step (first step) in the production of the molded article 1.

Each of the splits 21 and 22 is immersed in a fiber slurry tank (not shown), and the fiber slurry is sucked up to deposit fibers on the papermaking screen to form a fiber preform 10*a* or 10*b* having an almost arch-shaped cross-section as shown in FIG. 5(*b*).

In the second step, the splits 21 and 22 having formed thereon the fiber preforms 10*a* and 10*b*, respectively, are joined in the fiber slurry while the pressing member 3 is placed in the cavity 20 formed by the joined splits 21 and 22.

The pressing member 3 is disposed on the fiber preform 10*a* of the split 21 (one of the halves) before the splits 21 and 22 are joined together.

In placing the pressing member 3, the pressing member is set in the guide trough 34 which is bent in agreement with the cavity-forming surface 21*a* and placed on the fiber preform 10*a* as shown in FIG. 5(*b*). After the pressing member 3 is placed, the guide trough 34 is separated from the pressing member 3 and taken out of the cavity.

As shown in FIG. 5(*c*), the splits 21 and 22 are joined along their joint surfaces to close the papermaking mold 2. While the papermaking mold 2 is being closed, suction of the fiber slurry is continued to further deposit fibers on the inner side of the fiber preforms 10*a* and 10*b*. The molded article thus obtained has high strength with no joint seams nor level differences.

After the pressing member 3 is placed in the cavity, the dewatering step (third step) starts. The papermaking mold 2 and the pressing member 3 in the state illustrated in FIG. 5(*c*) are taken out of the fiber slurry to conduct dewatering. Dewatering may start before the papermaking mold 2 and the pressing member 3 are pulled out of the fiber slurry.

In the dewatering step, a fluid is fed into the pressing member 3 to expand it thereby to press the fiber preforms 10*a* and 10*b* toward the inner wall of the papermaking mold 2. The papermaking mold 2 and the pressing member 3 are then pulled out of the fiber slurry, and the pressing by the pressing member 3 is continued to dewater the fiber preforms 10*a* and 10*b* to form the molded article 1. By expanding the pressing member 3 in the fiber slurry in the tank, a high-strength molded article with no seams nor level differences can be obtained.

The pressure of feeding the fluid into the pressing member 3 is appropriately decided according to the fiber preforms to be dewatered. It is preferably 0.01 to 5 MPa, more preferably 0.1 to 3 MPa.

In the dewatering step, the water content of the fiber preforms 10*a* and 10*b* is sucked up through the flow passageways 21*b* and 22*b*, etc. while pressing by the pressing member 3. By such pressing, the molded article 1 is dewatered rapidly while being uniformly pressed to become uniform in wall thickness.

Upon the molded article 1 reaching a prescribed water content, the suction through the flow passageways 21*b* and 22*b*, etc. is stopped, and the fluid in the pressing member 3 is withdrawn to let the pressing member 3 shrink. The splits 21 and 22 are separated apart to remove the wet molded article 1 and the pressing member 3 from the papermaking mold 2 as shown in FIG. 5(*d*).

The molded article 1 having been dewatered preferably has a water content of 30 to 70%, particularly 40 to 60%, from the viewpoint of preventing damage to the molded article 1 in transfer to the subsequent drying step and assuring improved drying efficiency in the drying step.

As shown in FIG. 6(*a*), the thus dewatered wet molded article 1 and the pressing member 3 are transferred to between the splits 41 and 42 of the drying mold 4 by the transfer means (not shown) to be ready for the drying step (fourth step).

As shown in FIG. 6(*b*), the splits 41 and 42 are joined along their joint surfaces to have the molded article 1 and the pressing member 3 disposed in the cavity of the drying mold 4.

The drying mold 4 is heated and maintained at a prescribed temperature by the heating means 41*e*, 42*e*. The temperature of the drying mold 4 is preferably 100 to 250° C., more preferably 150 to 220°C., for preventing the molded article 1 from scorching while securing the drying efficiency.

A fluid is supplied to the pressing member 3 to expand it. The molded article 1 is dried while being pressed toward the inner wall of the drying mold 4 by the expanded pressing member 3.

The pressure of feeding the fluid into the pressing member 3 is appropriately decided according to the molded article to be dried. It is preferably 0.01 to 5 MPa, more preferably 0.1 to 3 MPa. The same fluid as used in the dewatering step can be used to expand the pressing member 3.

In the drying step, while the molded article 1 is pressed by the pressing member 3, the water content of the molded article 1 is sucked up through the flow passageways 41*b* and 42*b*, etc. Thus, the molded article 1 is dried rapidly while being uniformly pressed from its inside to become uniform in wall thickness.

Upon the molded article 1 reaching a prescribed water content, the suction through the flow passageways 41*b* and 42*b*, etc. is stopped, and the fluid in the pressing member 3 is withdrawn to let the pressing member 3 shrink.

After an elapse of a prescribed time, the splits 41 and 42 are separated apart to take out the molded article 1 from the drying mold 4 as shown in FIG. 6(*c*). One end of the pressing member 3 is detached from the head 33, and the pressing member 3 is extracted from the molded article 1 to complete the drying step. The end of the pressing member 3 may be detached from the head 33 before the splits 41 and 42 are separated.

After completion of the drying step, each of the opening ends 1*a* and 1*b* of the molded article 1 is curled outward to form the flanges 1*c* and 1*d* by pressing onto an annular groove of a die (not shown) having a cross-section with a prescribed curvature.

If desired, the molded article 1 can be subjected to various post treatments, such as trimming, attachment of a separate part, coating on the inner and/or outer surface with a resin layer, printing, and water repellency treatment. In particular, a sodium silicate layer and/or a silicone resin layer provided on the surface of the molded article 1 brings about improved resistance to heat and water.

The molded article 1 thus produced according to this embodiment has a complicate shape having two bends but no joint seams, a thin and uniform wall thickness, a light weight, and strength. Protected by the flanges 1*c* and 1*d*, the ends of the molded article 1 are protected against damage. Because the molded article 1 has high sound absorbing qualities, it is effective in reducing the sound generated when solid, gas, etc. flows therethrough.

In the method of producing a fiber-molded hollow article according to this embodiment using the production apparatus 100, it is after the splits 21 and 22 are joined into the papermaking mold 2 in the fiber slurry that the splits 21 and 22 are pulled out of the fiber slurry. Then, the fiber preforms 10*a* and 10*b* are dewatered and molded while being pressed by the pressing member 3. As a result, the wet fiber preforms 10*a* and 10*b* are united into one body while being dewatered to give a molded article 1 with a uniform thickness and no seams.

Since the guide trough 34 shaped to the bent configuration of the cavity-forming surface 21*a* is used in placing the pressing member 3 in the cavity, the pressing member 3 can be maintained in a shape in agreement with the bent configuration of the cavity 20-forming surface 21*a*. Since the splits 21 and 22 are joined after the pressing member 3 is disposed on the fiber preform 10*a*, the pressing member 3 can be surely disposed in the cavity however complicated the bent configuration may be.

Since the papermaking mold 2 is divided into the splits 21 and 22, even a complicated cavity configuration can be formed to produce fiber-molded hollow articles of various complicated shapes.

Because the molded article 1 is transferred to the drying step while containing the pressing member 3 used in the papermaking step, the transfer from the papermaking step to the drying step can be carried out smoothly in a short time.

Since the drying step is carried out while the molded article 1 is pressed toward the inner wall of the drying mold 4 by the pressing member 3, the molded article 1 can be dried efficiently to provide a high-strength molded article with a thin and uniform wall thickness.

The present invention is by no means limited to the above-mentioned embodiments, and appropriate modifications can be made therein without departing from the spirit and scope of the present invention.

In the present invention it is preferred that a pair of almost arch-shaped fiber preforms, which are united together into one body and then dewatered and shaped as in the first and second embodiments described supra. It is also possible to form a pair of flanged, arch-shaped fiber preforms 10*a* and 10*b* having flanges 10*c* and 10*d* on both sides of the joint surfaces as shown in FIG. 7(*a*), which are united together and dewatered into a fiber-molded hollow article 1 with side projections lc as shown in FIG. 7(*d*).

Figures 7A, 7B, 7C, 7D, 7E, 7F:
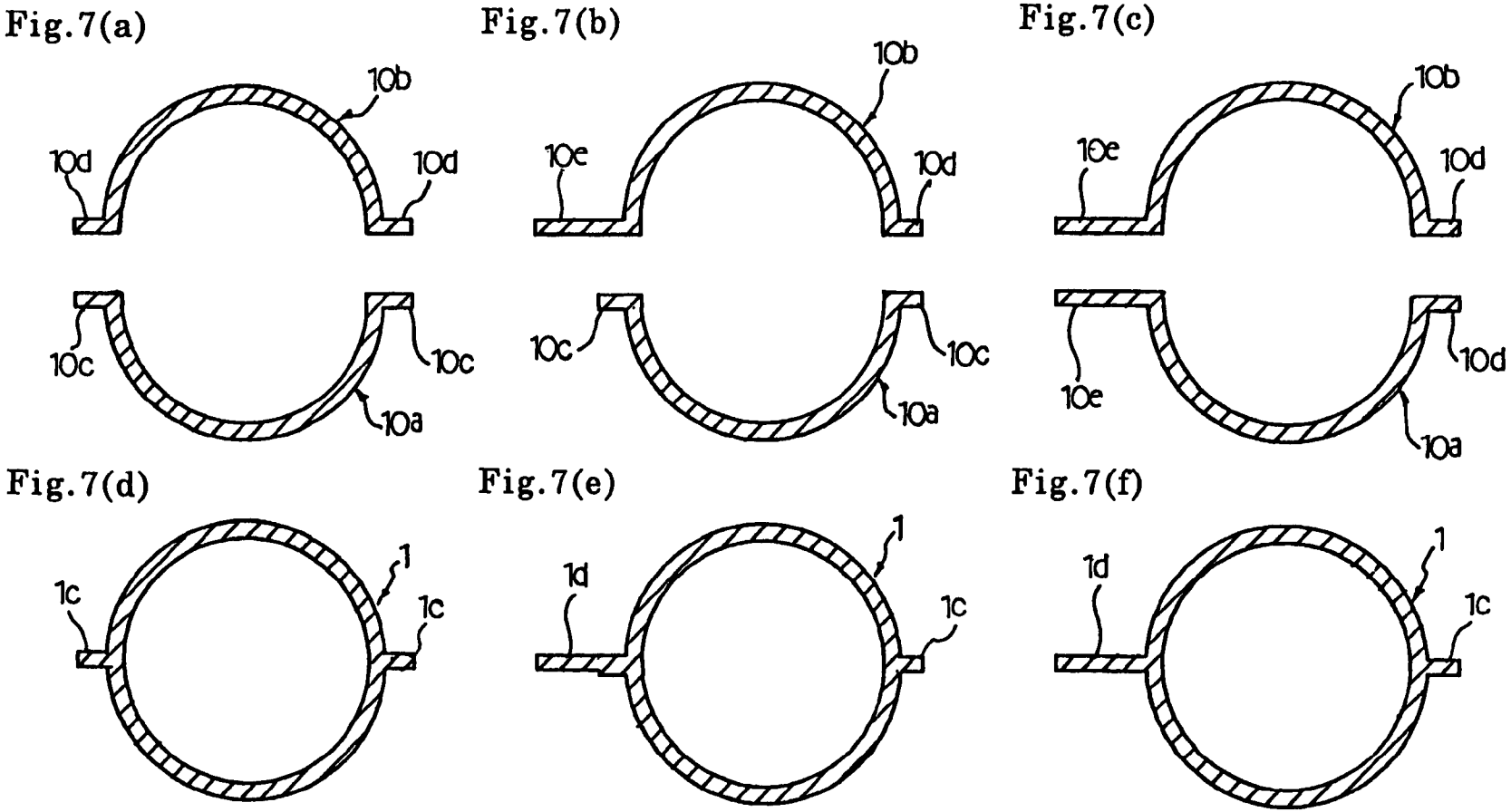
FIGS. 7(*a*) through 7(*f*) schematically illustrate a step for producing a fiber-molded hollow article from fiber preforms in another embodiment of the present invention.

In making a fiber-molded hollow article having a side projection for fitting, it is possible that flanged fiber preforms lO*a* and 1O*b* having a flange lO*e* providing a side projection for fitting are formed as shown in FIGS. 7(*b*) and 7(*d*), which are united together and dewatered into a fiber-molded hollow article 1 having the side projection 1*d* for fitting as shown in FIGS. 7(*e*) and 7(*f*).

In the present invention it is preferred, as in the first and second embodiments, that dewatering be performed by sucking the water content of the fiber preforms through the flow passageways 21*b* and 22*b*, etc. while pressing the fiber preforms toward the inner wall of the papermaking mold 2 by the pressing member 3. The manner of dewatering is not limited thereto, though. For example, after the press dewatering by the expanded pressing member combined with the suction dewatering through the flow passageways, blow dewatering can follow, in which the fluid is withdrawn from the pressing member, and a fluid for dewatering is blown through the gap generated between the pressing member and the fiber preforms. Two or more of dewatering manners may be combined appropriately.

In the present invention it is preferred, as in the first and second embodiments, that the fiber preforms are brought into integral molded article 1 during dewatering, which is dried in the drying mold 4 while being pressed from its inside. It is possible that the wet molded article 1 is separated from the pressing member 3 on completion of the dewatering step and dried alone in various tunnel type driers.

In the method of the first and second embodiments, the fiber preforms 10*a* and 10*b* are united into the molded article 1 having two openings 1*a* and 1*b*. It is also possible that a plurality of fiber preforms are united to form a molded article with one end open and the other closed, which is then made into a molded article with two openings by, for example, cutting off the closed end.

In the method of the present invention, it is preferred that the dewatered fiber-molded hollow article is transferred to the drying mold by the transfer means as in the first and second embodiments. It is also possible that the molded article is transferred directly from the papermaking mold to the drying mold by making use of, for example, suction of the molded article 1 to one of the splits.

For example, the pressing member 3 and one of the splits of the papermaking mold are moved together with the molded article 1 sucked by the split through the passageways of the split. The split is faced to one of the splits of the drying mold, and the two splits are joined. The molded article 1 is then sucked through the passageways of the split of the drying mold while compressed air is ejected from the passageways of the split of the papermaking mold to release the molded article 1 from the split of the papermaking mold. Then, the split of the papermaking mold is replaced with the other split of the drying mold. The two facing splits of the drying mold are joined to place the molded article 1 and the pressing member 3 in the cavity of the drying mold.

This method is particularly suited for transferring long molded articles or thin-walled molded articles.

While the papermaking mold and the drying mold used in the method according to the first and second embodiments are composed of two splits, it is possible to use a papermaking mold and a drying mold each composed of three or more splits which are assembled to form a cavity of prescribed shape in accordance with the shape of the molded article to be produced. Further, while a pair of fiber preforms are united into a molded article in the first and second embodiments, three or more preforms separately formed may be combined into a molded article.

While it is preferred that each split has the joint surface on a plane as in the method according to the first and second embodiments, it is possible for producing a special molded article that the joint surface is not on a plane (for example, the joint surface may be on a curved surface) so that the molded article may be removed with ease.

It is preferred that the papermaking mold and the drying mold have substantially the same cavity shape as in the method of the first and second embodiments, it is 1 possible that the papermaking mold and the drying mold have different cavity shapes so that the molded article 1 may be provided with a bend, a twist, etc. in the drying step by pressing the molded article 1 toward the inner wall of the drying mold 4 by the pressing member 3.

As stated with respect to the first and second embodiments, the method of producing a fiber-molded hollow article according to the present invention is especially suited to produce fiber-molded hollow articles with two openings. The method is also applicable to the production of fiber-molded hollow articles with three or more openings.

The papermaking mold or the drying mold used in the present invention may have a two-dimensional bend or a three-dimensional bend.

In the present invention it is preferred to use splits provided with a papermaking screen covering the cavity-forming surface as in the first and second embodiments, the papermaking screen may be replaced with nonwoven fabric or any other liquid permeable material to cover the cavity-forming surface. Otherwise, the papermaking mold can be composed of splits made of a porous material. In this case, the liquid permeable material can be omitted.

While a single pressing member is used in the first and second embodiments, two or more pressing members can be used in accordance with the shape of the fiber-molded hollow article.

While it is preferred to place the pressing member 3 into the cavity by using the guide trough 34 in the fiber slurry as in the second embodiment, it is possible to place the pressing member 3 into the cavity outside of the fiber slurry.

While in the second embodiment the flanges are formed by curling the opening ends after the drying step, it is possible to form the flanges during papermaking by using papermaking mold splits having depressions on their cavity-forming surface in agreement with the flanges to be formed.

It is also possible to attach a separately prepared flange member to the end of the resulting tubular molded article with no flanges.

The present invention is applicable to the production of a fiber-molded hollow article with a twist in place of the bend and a fiber-molded hollow article with both a twist and a bend.

The cross-section of the fiber molded article produced by the present invention is subject to variation according to the shape of the bend or twist. The molded article may have different diameters between the body and the end(s) or may have a tapered end(s) so as to make a connection through a tubular joint.

The fiber-molded hollow article of the present invention is not particularly restricted in application. It is preferably used, for example, as a hollow container with a small mouth or an odd-shaped hollow container.

Industrial Applicability:

The present invention provides a fiber-molded hollow article which can have various designs including such a complicatedly bent shape as has two or more bends and is composed of a plurality of fiber preforms firmly united into one body with a uniform wall thickness. The present invention also provides a method and an apparatus for producing a fiber molded article, by which the above-described molded article can be produced conveniently.

What is claimed is:

1. A method of producing a fiber-molded hollow article by using a papermaking mold composed of a set of splits which are joined to form a cavity having two or more openings connecting with the outside and an expandable pressing member adapted to be placed in the cavity, which comprises:

a first step of immersing each of the splits before being joined in a fiber slurry to form a fiber preform on the cavity-forming surface of the split, a second step of joining the splits each having said fiber preform formed thereon and placing said pressing member in the cavity, a third step of depositing a fiber layer on said fiber perform, and a fourth step of dewatering said fiber preforms in the papermaking mold to form a fiber-molded hollow article.

2. The method of producing a fiber-molded hollow article according to claim 1, wherein said pressing member is expanded in the cavity to press said fiber preforms toward the inner wall of the papermaking mold thereby to dewater and mold said fiber preforms.

3. The method of producing a fiber-molded hollow article according to claim 1, wherein the second step is carried out in the fiber slurry used in the first step.

4. The method of producing a fiber-molded hollow article according to claim 1, wherein said splits each have a large number of fluid flow passageways open on the cavity-forming surface thereof, a liquid permeable material is disposed to cover the cavity-forming surface, and the fiber slurry is sucked up through said flow passageways to deposit said fiber preform on said liquid permeable material.

5. The method of producing a fiber-molded hollow article according to claim 1, wherein said pressing member is placed on said part of the splits each having formed said fiber preform on the surface thereof while said part of the splits are right under the liquid level of the fiber slurry.

6. The method of producing a fiber-molded hollow article according to claim 1, wherein a weight is disposed in said pressing member.

7. The method of producing a fiber-molded hollow article according to claim 1, wherein the fiber-molded hollow article having been dewatered and molded by the pressing member and as containing said pressing member therein is released from the papermaking mold and disposed in a drying mold, and said pressing member is expanded to dry said fiber-molded hollow article.

8. A method of producing a fiber-molded hollow article comprising the steps of:

immersing part of a set of splits of a mold in a fiber slurry to form fiber preform(s) on the surface of the part of splits, placing a pressing member on said fiber preform(s), immersing the remaining part of the set of splits in the fiber slurry to form fiber preform(s) on the surface of the remaining part of the splits, and joining the set of splits each having said fiber preform formed thereon while being immersed in the fiber slurry to unite said fiber preforms into one body.

9. The method of producing a fiber-molded hollow article according to claim 8, wherein a fluid is fed into said pressing member in the papermaking mold formed by the joined set of the splits to expand said pressing member thereby to dewater a fiber molded article formed by uniting said fiber preforms.

10. The method of producing a fiber-molded hollow article according to claim 8, wherein said pressing member is placed on said part of the splits each having formed said fiber preform on the surface thereof while said part of the splits are right under the liquid level of the fiber slurry.

11. The method of producing a fiber-molded hollow article according to claim 8, wherein the step of joining the set of splits having the respective fiber preforms thereon is followed by the step of depositing a fiber layer on the surface of each of said fiber preforms.

12. The method of producing a fiber-molded hollow article according to claim 8, wherein a weight is disposed in said pressing member.

13. The method of producing a fiber-molded hollow article according to claim 8, wherein the fiber-molded hollow article having been dewatered and molded by the pressing member and as containing said pressing member therein is released from the papermaking mold and disposed in a drying mold, and said pressing member is expanded to dry said fiber-molded hollow article.

14. An apparatus for producing a fiber-molded hollow article comprising a papermaking mold composed of a set of splits which are adapted to be joined to form a cavity and a pressing member which is adapted to dewater fiber preforms each formed on each of the splits to form a fiber-molded hollow article, wherein said papermaking mold has two or more openings connecting with the outside, said pressing member is expandable and bendable so as to be placed in said cavity between at least two of said openings after said splits are joined, and said papermaking mold is configured such that a first of said two or more openings cannot be seen from a second of said two or more openings due to at least one bend in the papermaking mold.

15. The apparatus for producing a fiber-molded hollow article according to claim 14, which has a mold opening and closure mechanism for opening and closing said papermaking mold in a fiber slurry and a pressing member placement mechanism for placing said pressing member in one or both of said splits.

16. The apparatus for producing a fiber-molded hollow article according to claim 14, which has a drying mold for drying said fiber-molded hollow article and a transfer means for transferring the dewatered fiber-molded hollow article as having said pressing member therein to said drying mold.

17. A method of producing a fiber-molded hollow article comprising the steps of:

immersing part of a set of splits of a mold in a fiber slurry to form at least one fiber preform on the surface of the part of splits, placing a pressing member on said at least one fiber preform, immersing the remaining part of the set of splits in the fiber slurry to form at least one fiber preform on the surface of the remaining part of the splits, joining the set of splits each having said at least one fiber preform formed thereon while being immersed in the fiber slurry to unite said at least one fiber preform into one body, and forming a fiber layer on said at least one fiber preform.

18. The method of producing a fiber-molded hollow article according to claim 17, wherein a fluid is fed into said pressing member in the papermaking mold formed by the joined set of the splits to expand said pressing member thereby to dewater a fiber molded article formed by uniting said at least one fiber preform.

* * * * *